US009915906B2

(12) United States Patent
Egawa et al.

(10) Patent No.: US 9,915,906 B2
(45) Date of Patent: Mar. 13, 2018

(54) SHEET POST-PROCESSING DEVICE AND IMAGE FORMING SYSTEM PROVIDED WITH THE SAME

(71) Applicant: KYOCERA Document Solutions Inc., Osaka (JP)

(72) Inventors: Keisuke Egawa, Osaka (JP); Yasunori Ueno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/280,276

(22) Filed: Sep. 29, 2016

(65) Prior Publication Data

US 2017/0097605 A1 Apr. 6, 2017

(30) Foreign Application Priority Data

Oct. 6, 2015 (JP) ..... 2015-198132
Aug. 5, 2016 (JP) ..... 2016-154495

(51) Int. Cl.
*B65H 29/70* (2006.01)
*G03G 15/00* (2006.01)
(Continued)

(52) U.S. Cl.
CPC ..... *G03G 15/6582* (2013.01); *B65H 29/125* (2013.01); *B65H 29/52* (2013.01); *B65H 29/70* (2013.01); *B65H 31/02* (2013.01); *B65H 31/36* (2013.01); *B65H 37/04* (2013.01); *G03G 15/6544* (2013.01); *B65H 2301/4212* (2013.01); *B65H 2301/4213* (2013.01); *B65H 2301/5122* (2013.01); *B65H 2301/5152* (2013.01); *B65H 2301/51214* (2013.01); *B65H 2403/942* (2013.01); *B65H 2404/1442* (2013.01); *B65H 2404/1521* (2013.01); *B65H 2404/61* (2013.01); *B65H 2404/63* (2013.01); *B65H 2404/693* (2013.01); *B65H 2511/51* (2013.01);
(Continued)

(58) Field of Classification Search
CPC ..... G03G 15/6582; G03G 2215/00818; B65H 29/70; B65H 2404/144; B65H 2404/1442
See application file for complete search history.

(56) References Cited

U.S. PATENT DOCUMENTS 7,165,764 B2 * 1/2007 Nakamura ..... B42C 1/12 270/58.08
8,678,367 B2 * 3/2014 Shimakawa ..... B65H 31/36 270/58.07

(Continued)

FOREIGN PATENT DOCUMENTS

JP 2000-211802 A 8/2000
JP 2002-68577 A 3/2002

*Primary Examiner* — Jeremy R Severson
(74) *Attorney, Agent, or Firm* — Stein IP, LLC

(57) ABSTRACT

A sheet post-processing device of the present disclosure is provided with a punch hole forming device, a processing tray, an ejection tray, a conveyance roller pair, an ejection roller pair, and a stiffening member. In a case where a sheet through which punch holes have been formed is to be ejected on the ejection tray without being subjected to post-processing on the processing tray, in a state where the stiffening member is retracted in a direction away from the sheet, the conveyance roller pair conveys the sheet until at least a tip end thereof reaches on the ejection tray.

11 Claims, 5 Drawing Sheets

(51) Int. Cl.

| | |
|---|---|
| ***B65H 29/12*** | (2006.01) |
| ***B65H 29/52*** | (2006.01) |
| ***B65H 31/02*** | (2006.01) |
| ***B65H 31/36*** | (2006.01) |
| ***B65H 37/04*** | (2006.01) |

(52) U.S. Cl.
CPC ..... *B65H 2511/515* (2013.01); *B65H 2701/1211* (2013.01); *B65H 2701/132* (2013.01); *B65H 2701/1311* (2013.01); *B65H 2701/1313* (2013.01); *B65H 2801/27* (2013.01); *G03G 2215/00818* (2013.01)

(56) References Cited

U.S. PATENT DOCUMENTS

| | | | | |
|---|---|---|---|---|
| 9,454,122 | B1 * | 9/2016 | Dobashi | G03G 15/6582 |
| 2010/0289205 | A1 * | 11/2010 | Taki | B65H 31/02 270/58.08 |
| 2014/0020533 | A1 * | 1/2014 | Watanabe | B26F 1/0092 83/110 |

* cited by examiner

SHEET POST-PROCESSING DEVICE AND IMAGE FORMING SYSTEM PROVIDED WITH THE SAME

INCORPORATION BY REFERENCE

This application is based upon and claims the benefit of priority from the corresponding Japanese Patent Application No. 2015-198132 filed on Oct. 6, 2015 and the corresponding Japanese Patent Application No. 2016-154495 filed on Aug. 5, 2016, the entire contents of which are incorporated herein by reference.

BACKGROUND

The present disclosure relates to a sheet post-processing device that performs post-processing including a punch hole forming process, a binding process, and so on with respect to a sheet such as a paper sheet on which an image has been formed by an image forming apparatus such as a copy machine, facsimile, or a printer, and an image forming system provided with the same.

Conventionally, there is used a paper sheet post-processing device that is capable of executing post-processing including a binding process of stacking a plurality of paper sheets (sheets) on each of which an image has been formed by an image forming apparatus such as a copy machine or a printer and binding together a bundle of the thus stacked paper sheets with a staple(s), a punch hole forming process of forming punch holes (perforations) therethrough by using a punch hole forming device, and so on.

In such a paper sheet post-processing device, the punch hole forming device is configured to form a plurality of punch holes through a paper sheet along its end edge not in a conveyance direction thereof but in a direction orthogonal to the conveyance direction. This is because of the following reasons. That is, in a case where punch holes are formed through a paper sheet along its end edge in a conveyance direction thereof, there arises a need for temporarily stopping conveyance of the paper sheet, causing a fear of impairing productivity (processing efficiency). Also, in an image forming apparatus that is capable of printing on an A3-size paper sheet, lateral conveyance (lateral paper passing) of an A4-size paper sheet is enabled, and hence there has been no demand to form punch holes through a paper sheet along its end edge in a conveyance direction thereof.

In recent years, however, in response to a request for a space-saving image forming apparatus, an image forming apparatus of a type that performs longitudinal conveyance (longitudinal paper passing) of an A4-size paper sheet has been on the market. Correspondingly therewith, there is, therefore, also a rising demand to form punch holes through a paper sheet along its end edge in a conveyance direction thereof.

As a method for forming a plurality of punch holes in a paper sheet conveyance direction, it is known to use a post-processing device that changes perforation positions with respect to a center line of a sheet so that, in performing a folding process with respect to the sheet after being subjected to a perforation process, with the sheet folded, two of four perforations formed therethrough coincide with the other two. Furthermore, a sheet post-processing device that forms punch holes without stopping conveyance of a sheet being conveyed also is known, in which a perforation device and an end part detection unit that detects a side end of the sheet are made movable in a direction orthogonal to a conveyance direction of the sheet so that punch holes are formed at positions corresponding to a size of the sheet conveyed thereto.

By the way, normally, before being ejected on an ejection tray, a paper sheet is subjected to stiffening by a stiffening member so as not to be rolled up. Due to stiffening, however, as shown in FIG. 6, each end part of a subsequent paper sheet 201 in a width direction thereof (a direction perpendicular to a paper sheet conveyance direction) is disposed more inwardly than each end part of a paper sheet 200 in a width direction thereof, which has already been ejected.

SUMMARY

A sheet post-processing device according to a first aspect of the present disclosure is provided with a punch hole forming device, a processing tray, an ejection tray, an ejection roller pair, a conveyance roller pair, a stiffening member, and an on-tray processing portion. The punch hole forming device forms punch holes along a side end edge of a sheet parallel to a sheet conveyance direction. The processing tray is disposed on a downstream side of the punch hole forming device in the sheet conveyance direction, and accepts and loads thereon a-predetermined number of sheets. The ejection tray is disposed on a downstream side of the processing tray in the sheet conveyance direction, and a sheet is ejected thereon. The ejection roller pair ejects, on the ejection tray, a sheet on the processing tray. The conveyance roller pair is disposed above an upstream side of the processing tray in the sheet conveyance direction and conveys a sheet. The stiffening member comes in contact with a sheet nipped between the ejection roller pair and deforms the sheet in a sheet thickness direction to impart stiffness to the sheet. The on-tray processing portion performs post-processing with respect to a sheet on the processing tray. In a case where a sheet through which punch holes have been formed is to be ejected on the ejection tray without being subjected to post-processing by the on-tray processing portion, in a state where the stiffening member is retracted in a direction away from the sheet, after the conveyance roller pair has conveyed the sheet until at least a tip end thereof reaches on the ejection tray, before a rear end of the sheet passes through the conveyance roller pair, the ejection roller pair nips the sheet, with the stiffening member imparting stiffness to the sheet, and then the ejection roller pair ejects the sheet on the ejection tray.

Still other objects of the present disclosure and specific advantages provided by the present disclosure will be made further apparent from the following descriptions of embodiments.

DETAILED DESCRIPTION

With reference to the appended drawings, the following describes embodiments of the present disclosure.

First Embodiment

Figure 1:
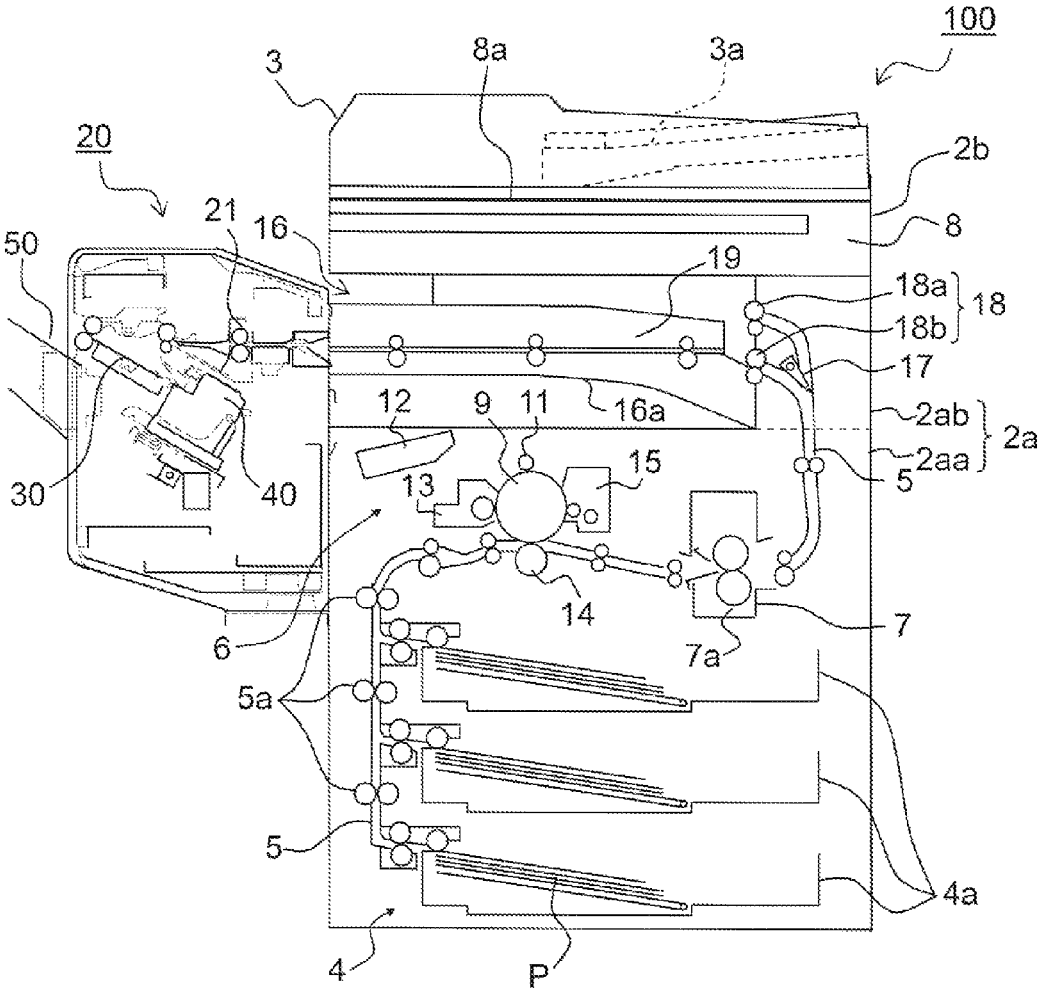
FIG. 1 is a schematic diagram showing respective internal configurations of a paper sheet post-processing device of a first embodiment of the present disclosure and an image forming apparatus.

First, with reference to FIG. 1, a description is given of an image forming system composed of a paper sheet post-processing device 20 of a first embodiment of the present disclosure and an image forming apparatus 100. FIG. 1 is a schematic diagram showing respective internal configurations of the image forming apparatus 100 and the paper sheet post-processing device 20 of the present disclosure. While this embodiment exemplarily shows a multi-functional peripheral as one example of the image forming apparatus 100, the paper sheet post-processing device 20 of the present disclosure can be joined not only to a digital multi-functional peripheral but also to other types of apparatuses in a similar manner, such as, for example, a laser printer, an ink jet printer, or a facsimile apparatus.

As shown in FIG. 1, the image forming apparatus 100 is a digital multi-functional peripheral of a so-called intra-body paper ejection type and is composed roughly of a main body housing 2*a* and an upper housing 2*b* that is arranged at an upper part of the main body housing 2*a*. The upper housing 2*b* is provided with after-mentioned various types of mechanisms for reading an image of an original document as an electric signal, and an original document conveyance device 3 is annexed to an upper part of the upper housing 2*b*. The main body housing 2*a*, on the other hand, is provided with after-mentioned various types of mechanisms for transferring an image on a paper sheet (sheet) based on an electric signal of a read original document image, and the paper sheet post-processing device (sheet post-processing device) 20 is annexed to a left side part of the main body housing 2*a*.

In this embodiment, the main body housing 2*a* is composed of a lower housing 2*aa* and a joint housing 2*ab* that is positioned above the lower housing 2*aa* along a right side part and is joined to the upper housing 2*b*. In the lower housing 2*aa*, there are provided a paper feed portion 4 of a paper sheet P, an image forming portion 6 that forms a toner image on the paper sheet P, a fixing device 7 for fixing the toner image on the paper sheet P, and so on. On the other hand, in the joint housing 2*ab*, there is provided a paper sheet ejection portion (ejection portion) 18 for conveying the paper sheet P after being subjected to the fixing to eject it from the main body housing 2*a*.

Furthermore, at an area on a left side of the joint housing 2*ab* immediately below the upper housing 2*b*, an intra-body paper ejection space 16 is formed that is largely open toward a left side surface and a front surface of the image forming apparatus 100. In the intra-body paper ejection space 16, there is provided a relay unit 19 that accepts and loads thereon the paper sheet P ejected from a left side surface of the joint housing 2*ab* and, in a case of subjecting the paper sheet P to a predetermined type of post-processing, enables conveyance of the paper sheet P to the paper sheet post-processing device 20.

Inside the main body housing 2*a*, there are provided the paper feed portion 4 that is arranged at a lower part, a paper sheet conveyance portion 5 that is arranged at a side of and above the paper feed portion 4, the image forming portion 6 that is arranged above the paper feed portion 4, and the fixing device 7 that is arranged on a downstream side of the image forming portion 6 in a paper sheet conveyance direction (a right side in FIG. 1).

In the paper feed portion 4, there are provided a plurality of paper feed cassettes 4*a* each provided, on a downstream side in the paper sheet conveyance direction, with a separate-feed unit such as a paper feed roller, and each of the paper feed cassettes 4*a* is to feed, by a rotation operation of the paper feed roller, a bundle of the paper sheets P placed therein, one by one, from an uppermost one thereof to the paper sheet conveyance portion 5. By using conveyance roller pairs 5*a*, the paper sheet conveyance portion 5 conveys the paper sheet P fed from the paper feed portion 4 to the image forming portion 6.

In an inner part of a main body of the image forming apparatus 100, each of the image forming portion 6 and the fixing device 7 is arranged so as to be elongated in a width direction orthogonal to the paper sheet conveyance direction (a forward-rearward direction, a direction orthogonal to a paper plane of FIG. 1). In an upper part inside the lower housing 2*aa*, from a left side in FIG. 1, the image forming portion 6 and the fixing device 7 are provided side by side in this order in the conveyance direction of the paper sheet P (a left-to-right direction).

The image forming portion 6 is to form a predetermined toner image on the paper sheet P by an electrophotographic process, and is provided with, in addition to a photosensitive drum 9 that is an image carrier axially supported so as to be rotatable, a charging device 11, an exposure device 12, a developing device 13, a transfer device 14, a cleaning device 15, and an unshown static elimination device, which are arranged around the photosensitive drum 9 along a rotation direction thereof. The fixing device 7 is to heat and press the paper sheet P on which a toner image has been transferred at the image forming portion 6 by sandwiching it between a fixing roller pair 7*a* that is composed of a heating roller and a pressing roller so that the unfixed toner image is fixed on the paper sheet P.

Inside the upper housing 2*b*, an image reading portion 8 is provided. The image reading portion 8 is to read image information of an original document. In a case where an original document is manually placed one by one to be read, the original document conveyance device 3 is opened, and the original document is placed on a contact glass 8*a* that is provided on an upper surface of the upper housing 2*b*, while in a case where an original document is automatically read one by one from a bundle of original documents, the bundle of original documents is placed on a paper feed tray 3*a* of the original document conveyance device 3 in a closed state. In a case where a bundle of original documents is placed on the paper feed tray 3*a*, an original document is automatically and sequentially fed one by one from said bundle of original documents onto the contact glass 8*a*. In either case, an original document positioned on the contact glass 8*a* is irradiated with light from an unshown exposure lamp, and reflection light thereof as image light is led to a photoelectric conversion portion (CCD) via optical systems such as a reflection mirror and an imaging lens (neither of these is shown).

The following describes a basic operation of the image forming apparatus 100 configured as above. First, by the charging device 11, a surface of the photosensitive drum 9 that rotates counterclockwise in FIG. 1 is uniformly charged. Subsequently, based on image information read at the image reading portion 8, a peripheral surface of the photosensitive drum 9 is irradiated with a laser beam from the exposure device 12 (such as a laser device), and thus an electrostatic latent image is formed on the surface of the photosensitive drum 9. From the developing device 13, toner as a developer is supplied to this electrostatic latent image to form a toner image.

Next, the paper sheet P from the paper feed portion 4 passes through a paper sheet conveyance path 5 to be conveyed at predetermined timing toward the photosensitive drum 9 on which the toner image has been formed, where the toner image on the surface of the photosensitive drum 9 is transferred on the paper sheet P by the transfer device 14 formed of a transfer roller or the like. Then, the paper sheet P on which the toner image has been transferred is separated from the photosensitive drum 9 and is conveyed toward the fixing device 7. When passing between the fixing roller pair 7*a*, the paper sheet P is subjected to a heating and pressing process, and thus the toner image is fixed.

After the transfer process of transferring the toner image on the paper sheet P is completed, residual toner remaining on the peripheral surface of the photosensitive drum 9 is removed by the cleaning device 15, and then the photosensitive drum 9 is subjected to a static elimination process of eliminating residual electric charge by the static elimination device (not shown). After that, the peripheral surface is subjected again to a charging process by the charging device 11, and thereafter, subsequent image formation is performed in a similar manner.

The paper sheet P that has passed through the fixing device 7 is conveyed, as it is, perpendicularly upward along the paper sheet conveyance path 5 into the joint housing 2*ab*. Inside the joint housing 2*ab*, an upper part of the paper sheet conveyance path 5 is branched leftward into two upper and lower conveyance paths, and the conveyance direction of the paper sheet P is switched by a switch claw 17 that is disposed at a branching portion.

Inside the joint housing 2*ab*, the paper sheet ejection portion 18 is provided. The paper sheet ejection portion 18 has an upper ejection roller pair 18*a* and a lower ejection roller pair 18*b* that is disposed immediately below the upper ejection roller pair 18*a*, and the paper sheet P conveyed along the paper sheet conveyance path 5 is guided to the upper conveyance path or the lower conveyance path by the switch claw 17.

When guided to the upper conveyance path by the switch claw 17, the paper sheet P is ejected leftward from the upper ejection roller pair 18*a*, and when guided to the lower conveyance path by the switch claw 17, the paper sheet P is ejected leftward from the lower ejection roller pair 18*b*. A guiding direction of the switch claw 17 is switched by a control portion 70 (see FIG. 5). The control portion 70 is provided in the image forming apparatus 100 and controls the entire image forming system (the image forming apparatus 100 and the paper sheet post-processing device 20).

The relay unit 19 is demountably mounted to a bottom surface 16*a* of the intra-body paper ejection space 16, and in the intra-body paper ejection space 16, a detection sensor (not shown) that detects mounting of the relay unit 19 is provided. The detection sensor is formed of a PI sensor or the like and transmits a detection result to the control portion 70.

Furthermore, the bottom surface 16*a* has an inclined surface formed thereon, which is inclined upward toward a downstream side in a paper sheet ejection direction (a left side in FIG. 1), and when the relay unit 19 has been demounted from the intra-body paper ejection space 16, the bottom surface 16*a* is used as a paper sheet ejection tray. In this case, the detection sensor detects that the relay unit 19 has not been mounted, and upon this detection result being transmitted to the control portion 70, the switch claw 17 guides the paper sheet P to the upper ejection roller pair 18*a*. Then, the paper sheet P, after being ejected from the upper ejection roller pair 18*a*, is ejected on the bottom surface 16*a*.

On the other hand, in a case where the detection sensor detects that the relay unit 19 has been mounted in the intra-body paper ejection space 16, and this detection result is transmitted to the control portion 70, the switch claw 17 guides the paper sheet P to the lower ejection roller pair 18*b*. Then, after being ejected from the lower ejection roller pair 18*b*, the paper sheet P is carried into the relay unit 19. The paper sheet P that has been carried into the relay unit 19 passes through the relay unit 19 to be carried into the paper sheet post-processing device 20.

It is also possible to display a detection result on an operation portion 80 (see FIG. 5) so as to allow a user to switch a guiding direction of guiding the paper sheet P on an operation panel. Furthermore, an upper surface part of the relay unit 19 constitutes a paper sheet ejection tray on which the paper sheet P ejected from the upper ejection roller pair 18*a* is placed.

In an inner part of the paper sheet post-processing device 20, there are provided a punch hole forming device 21 that performs punch hole formation with respect to the paper sheet P that has been carried in, a processing tray 30 that loads (stacks) thereon a plurality of the paper sheets P that have been carried in, and a stapler (on-tray processing portion) 40 that binds a bundle of paper sheets loaded on the processing tray 30 with a staple(s). On a side surface of the paper sheet post-processing device 20, an ejection tray 50 is provided that is vertically movable to a position appropriate to eject the paper sheet P.

The punch hole forming device 21 is disposed at an upper part in the paper sheet post-processing device 20 and forms a plurality of punch holes through the paper sheet P along either of its side end edges (a forward side or a rearward side of the apparatus) parallel to the conveyance direction of the paper sheet P. On an upstream side of the punch hole forming device 21 and at substantially a middle part in a direction orthogonal to the paper sheet conveyance direction (a direction perpendicular to the paper plane of FIG. 1), a carrying-in detection sensor (not shown) is disposed that detects a tip end of the paper sheet P carried into the paper sheet post-processing device 20 by a paper sheet carrying-in roller pair inside the relay unit 19.

Based on detection timing at which the tip end of the paper sheet P is detected by the carrying-in detection sensor, the control portion 70 controls driving of the paper sheet carrying-in roller pair inside the relay unit 19, thereby adjusting, with respect to the paper sheet P conveyed to the punch hole forming device 21, punch hole forming positions thereon in the conveyance direction thereof. To be specific, a conveyance direction pulse adjustment value is set that is used to perform addition/subtraction to/from a reference conveyance pulse value for a period from a time when the tip end or a rear end of the paper sheet P is detected by the carrying-in detection sensor to a time when the paper sheet carrying-in roller pair is stopped.

Figure 2:
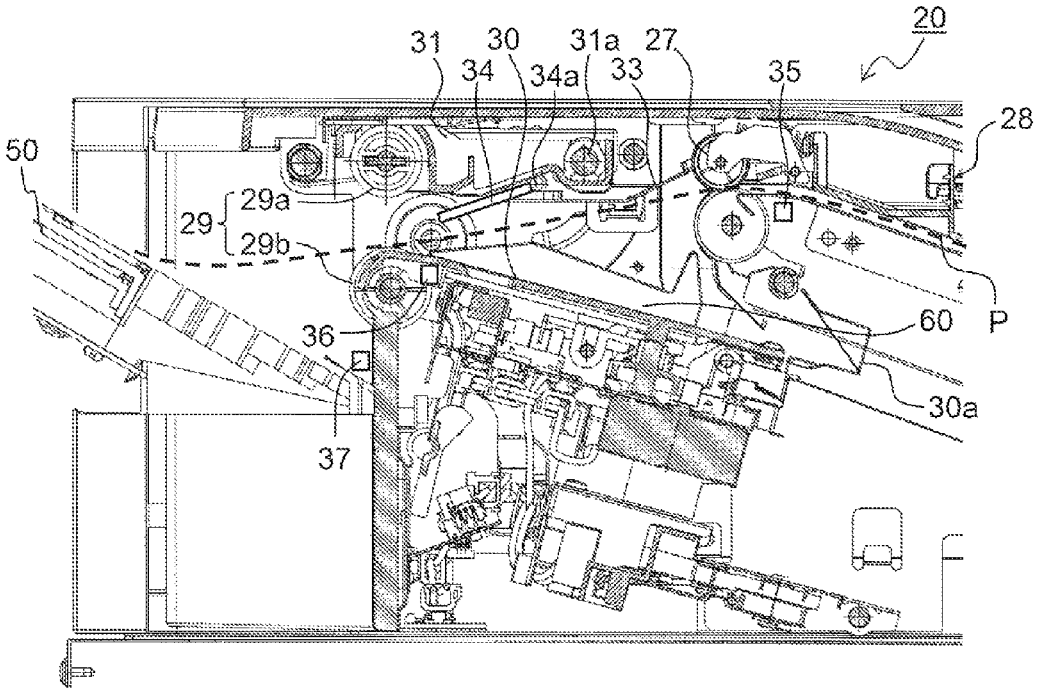
FIG. 2 is a partial enlarged view of a vicinity of a processing tray of the paper sheet post-processing device of the first embodiment of the present disclosure, which shows a state where a nip between a second ejection roller pair is released.
Figure 3:
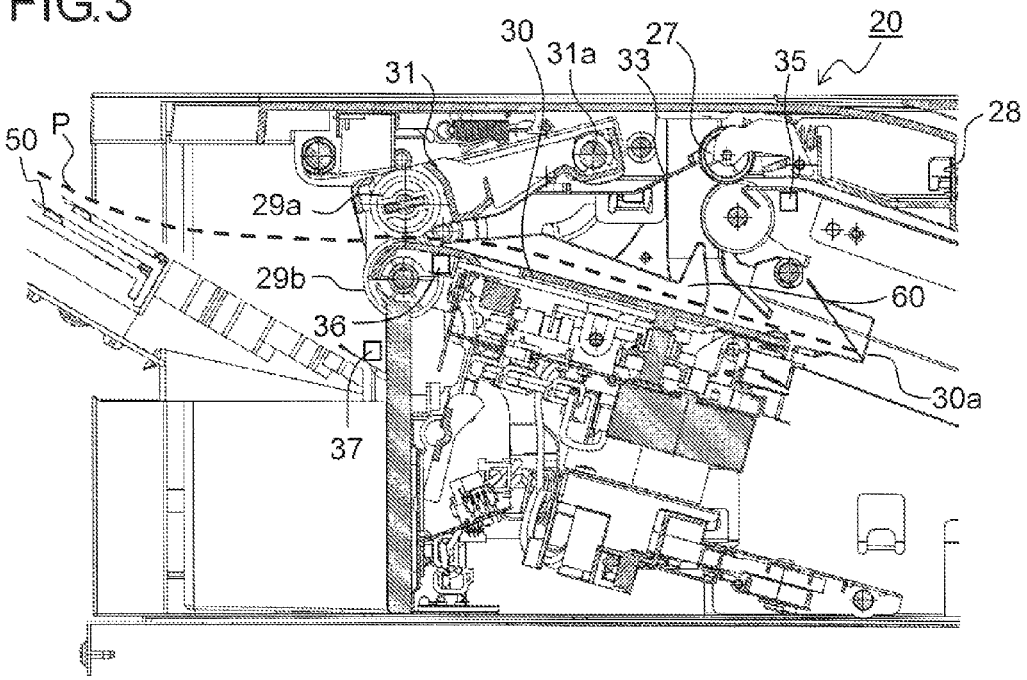
FIG. 3 is a partial enlarged view of the vicinity of the processing tray of the paper sheet post-processing device of the first embodiment of the present disclosure, which shows a state where the second ejection roller pair nips a paper sheet therebetween.

FIG. 2 and FIG. 3 are each a partial sectional view of a vicinity of the processing tray 30 inside the paper sheet post-processing device 20. With respect to the paper sheet conveyance direction, on a downstream side of the punch hole forming device 21 (see FIG. 1), a first ejection roller pair (conveyance roller pair) 27 is arranged. On an upstream side of the first ejection roller pair 27, an actuator-type paper sheet detection sensor 28 that detects passing of the paper sheet P is disposed.

Moreover, below the first ejection roller pair 27, there are provided the processing tray 30 that loads thereon, in an aligned state, a predetermined number of the paper sheets P conveyed by the first ejection roller pair 27 and the stapler 40 (see FIG. 1) that performs a binding process with respect to a bundle of the paper sheets P (a bundle of paper sheets) loaded on the processing tray 30.

Figure 4:
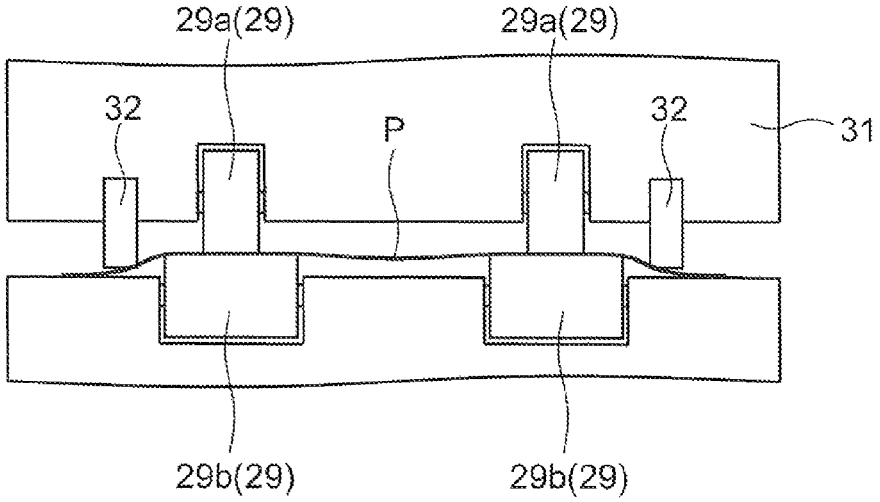
FIG. 4 is a diagram showing, from an ejection tray side, a vicinity of the second ejection roller pair of the first embodiment of the present disclosure.

With respect to the paper sheet conveyance direction, on a downstream side of the processing tray 30, a second ejection roller pair (ejection roller pair) 29 is arranged that ejects, from the processing tray 30, a bundle of paper sheets on the ejection tray 50. As shown in FIG. 4, a plurality (herein, two) of the second ejection roller pairs 29 are provided along a paper sheet width direction (a direction perpendicular to a paper plane of FIG. 2, a direction orthogonal to the paper sheet conveyance direction). Furthermore, each of the second ejection roller pairs 29 is composed of an ejection roller 29*a* that is made of rubber and is rotatable forwardly and reversely by a drive motor (not shown) and an ejection roller 29*b* that is made of resin and rotates following rotation of the ejection roller 29*a*. The ejection roller 29*a* is supported to a roller holder 31 (see FIG. 2) that is swingable up and down about a pivot shaft 31*a* as a fulcrum.

Furthermore, a plurality (herein, two) of stiffening members 32 that each protrude in a paper sheet thickness direction inside the paper sheet conveyance path are secured to the roller holder 31. Each of the stiffening members 32 protrudes downward past a nip position between the second ejection roller pair 29 and comes in contact with the paper sheet P nipped between the second ejection roller pair 29 to deform the paper sheet P in the paper sheet thickness direction, thereby imparting stiffness to the paper sheet P. Here, each of the stiffening members 32 is disposed on an outer side in the paper sheet width direction with respect to the ejection roller 29*a*, so that the paper sheet P is deformed by the stiffening members 32 in such a manner that its side end edges (side end edges along the punch holes) parallel to the paper sheet conveyance direction are bent downward. The stiffening members 32 may be disposed, for example, alternately with the ejection rollers 29*a* to deform the paper sheet P in a wave shape.

As shown in FIG. 2 and FIG. 3, above the processing tray 30 and on a downstream side of the first ejection roller pair 27 (a left side in FIG. 2), there is arranged an aligning member 33 for aligning the paper sheet P carried in by the first ejection roller pair 27 in line with a tray surface. Furthermore, above the processing tray 30 and on a downstream side of the aligning member 33 (the left side in FIG. 2), there is provided a paddle 34 that is formed of a rubber plate and is used to draw in the paper sheet P onto the processing tray 30 by rotating in a counterclockwise direction in FIG. 2.

The processing tray 30 is provided so as to be inclined downward toward a rear end side of the paper sheet P loaded thereon (a right side in FIG. 2). The paddle 34 rotates in the counterclockwise direction in FIG. 2 about a rotation center 34*a* to draw in the paper sheet P from the rear end side onto the processing tray 30, and the rear end of the paper sheet P comes in contact with a butting portion 30*a*. Thus, on the processing tray 30, a bundle of paper sheets is loaded in a state where rear ends of the paper sheets are aligned. Furthermore, on the processing tray 30, there is provided a pair of side end alignment cursors (on-tray processing portion) 60 that aligns, in the paper sheet width direction, a bundle of a-predetermined number of paper sheets loaded on the processing tray 30.

The stapler 40 is movable in the paper sheet width direction by a movement mechanism (not shown) and, depending on how a binding process is to be performed, moves to a predetermined position along a lower end part of the processing tray 30.

In a neighborhood of an upstream side of the first ejection roller pair 27, a paper sheet detection sensor 35 is provided that detects presence/absence of the paper sheet P. The paper sheet detection sensor 35 is formed of a PI sensor or the like and transmits a detection result to the control portion 70. In a case where the paper sheet P through which punch holes have been formed is to be ejected on the ejection tray 50 without being subjected to post-processing (post-processing on the processing tray 30) by the stapler 40 and the side end alignment cursors 60, upon detection of the rear end of the paper sheet P by the paper sheet detection sensor 35, the control portion 70 controls the roller holder 31 to swing downward so that the paper sheet P is nipped between the second ejection roller pair 29.

In a neighborhood of an upstream side of the second ejection roller pair 29, a paper sheet detection sensor 36 is provided that detects presence/absence of the paper sheet P. The paper sheet detection sensor 36 is formed of a PI sensor or the like and transmits a detection result to the control portion 70. Upon detection of the rear end of the paper sheet P by the paper sheet detection sensor 36, after a lapse of a predetermined length of time (for example, 100 ms) (after the paper sheet P has passed through the second ejection roller pair 29), the control portion 70 controls the roller holder 31 to swing upward to release a nip between the second ejection roller pair 29.

In a neighborhood of an upstream side of the ejection tray 50, a detection sensor 37 is provided that detects an uppermost surface of the paper sheets P placed on the ejection tray 50 (in a case where no paper sheet P is placed thereon, an upper surface (paper sheet placement surface) of the ejection tray 50). The detection sensor 37 is formed of a PI sensor or the like and transmits a detection result to the control portion 70. In a case where the paper sheet P through which punch holes have been formed is to be ejected on the ejection tray 50 without being subjected to post-processing by the stapler 40 and the side end alignment cursors 60, the control portion 70 adjusts a height at which the ejection tray 50 is positioned so that an uppermost surface of the paper sheets P placed on the ejection tray 50 (or the paper sheet placement surface of the ejection tray 50) is at an increased height compared with a case where the paper sheet P through which no punch holes have been formed is to be ejected on the ejection tray 50 without being subjected to post-processing by the stapler 40 and the side end alignment cursors 60, thus raising a height of a loading position of the paper sheet P as ejected on the ejection tray 50.

Figure 5:
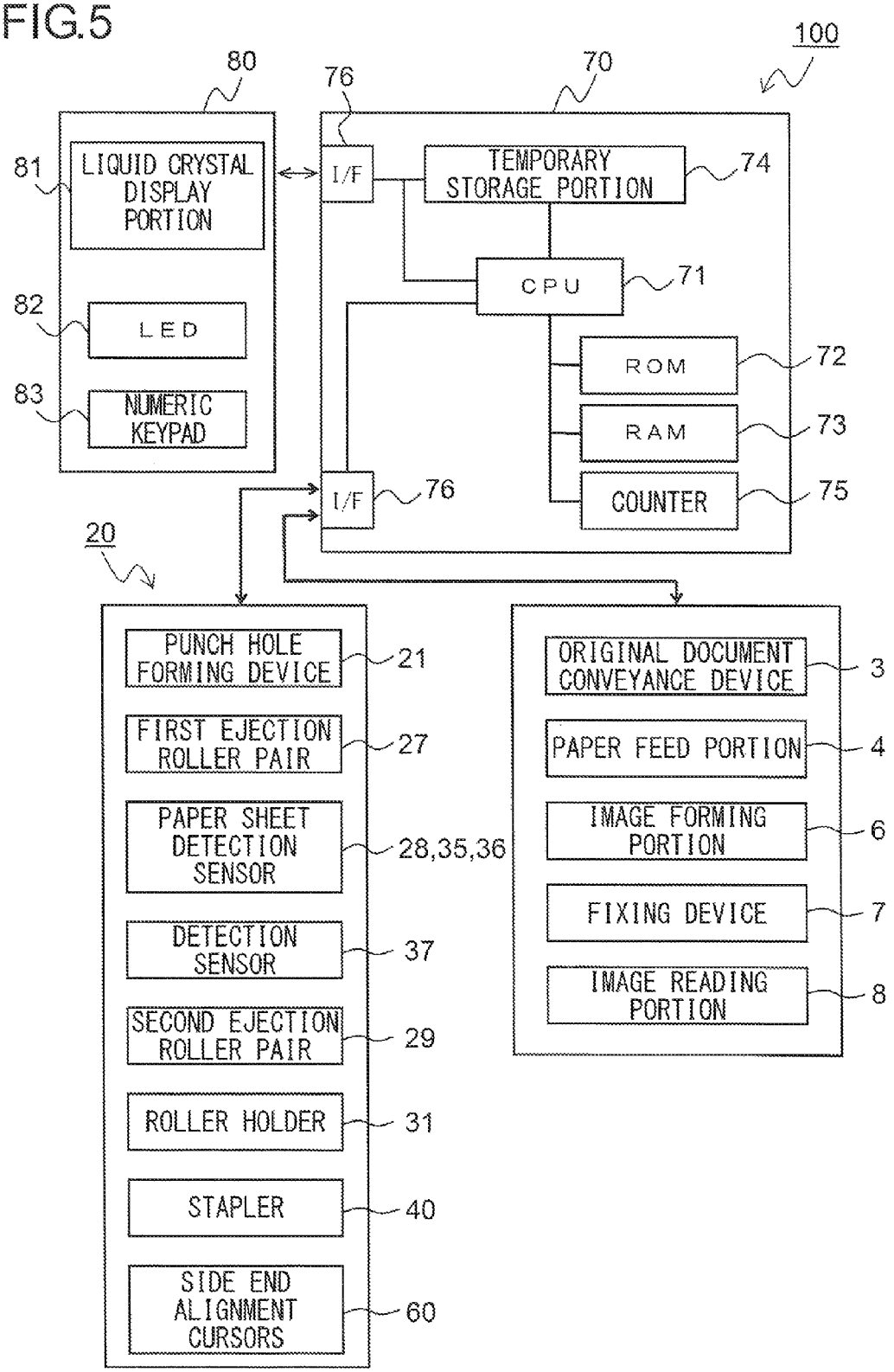
FIG. 5 is a block diagram showing a control route of an image forming system including the paper sheet post-processing device of the first embodiment of the present disclosure and the image forming apparatus.
Figure 6:
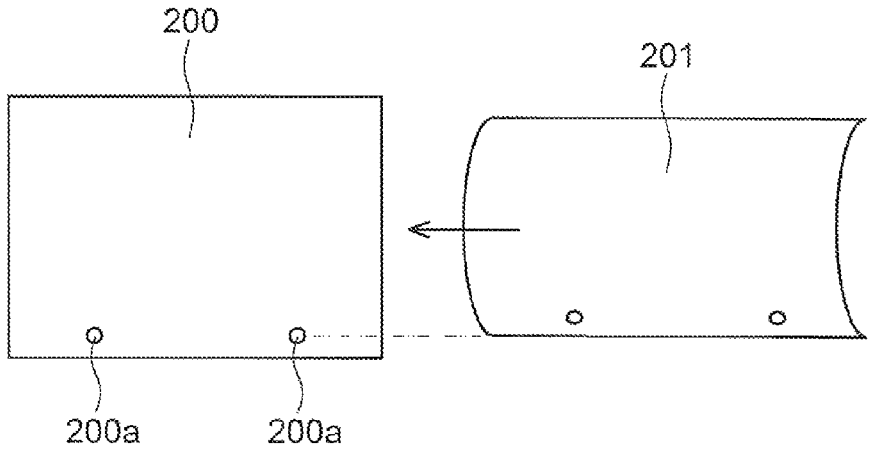
FIG.6 PRIOR ART
FIG. 6 is a diagram for explaining a conventional sheet post-processing device.

FIG. 5 is a block diagram showing a control route of the image forming system including the image forming apparatus 100 and the paper sheet post-processing device 20. In using the image forming system, the various portions of the apparatus are controlled in different ways, rendering the control portion 70 itself structurally complicated. FIG. 5, therefore, illustrates the control portion 70 and the paper sheet post-processing device 20 by focusing on portions thereof necessary to implement the present disclosure. While, herein, the entire image forming system is controlled by using the control portion 70 provided inside the image forming apparatus 100, it is also possible to provide a control portion inside the paper sheet post-processing device 20.

The control portion 70 is provided at least with a CPU (central processing unit) 71 as a central arithmetic processing unit, a ROM (read-only memory) 72 that is a read-only storage portion, a RAM (random-access memory) 73 that is a readable and rewritable storage portion, a temporary storage portion 74 that temporarily stores image data and so on, a counter 75, and a plurality (herein, two) of I/Fs (interfaces) 76. Via the I/Fs 76, the control portion 70 transmits a control signal to each of the various devices inside the image forming apparatus 100 and the paper sheet post-processing device 20 and receives an input signal from the operation portion 80.

The ROM 72 contains, for example, data not to be changed such as programs for controlling the system and numerical values necessary for the control. The RAM 73 stores necessary data generated in the course of controlling the system, data that becomes temporarily necessary for the control, and so on. Furthermore, the ROM 72 (or the RAM 73) also stores, for example, data related to a length of time from a time when the tip end or the rear end of the paper sheet P is detected by each of the detection sensors to a time when the paper sheet carrying-in roller pair is stopped or to a time when the roller holder 31 is made to swing.

The counter 75 counts a number of sheets printed at the image forming apparatus 100 and also counts, based on a detection signal of the carrying-in detection sensor, a number of the paper sheets P carried from the image forming apparatus 100 into the paper sheet post-processing device 20. Or alternatively, based on a detection signal of the paper sheet detection sensor 28 disposed on an upstream side of the processing tray 30 with respect to the paper sheet conveyance direction, the counter 75 counts a number of the paper sheets P carried in onto the processing tray 30. A configuration also may be adopted in which, without separately providing the counter 75, for example, the RAM 73 is set to store that number of the paper sheets P.

Furthermore, through the I/Fs 76, the control portion 70 transmits a control signal from the CPU 71 to each of the various portions and devices inside the system including the image forming apparatus 100 and the paper sheet post-processing device 20. Furthermore, through the I/Fs 76, from each of the various portions and devices, a signal indicating a status thereof and an input signal therefrom are transmitted to the CPU 71. The various portions and devices controlled by the control portion 70 include, for example, the paper sheet conveyance portion 5, the image forming portion 6, and the fixing device 7, which are included in the image forming apparatus 100 (for all of these, see FIG. 1), and the punch hole forming device 21, the first ejection roller pair 27, the second ejection roller pair 29, the roller holder 31, a drive portion (not shown) that drives the ejection tray 50 to move up and down, the stapler 40, and the side end alignment cursors 60, which are included in the paper sheet post-processing device 20.

In the operation portion 80, a liquid crystal display portion 81, an LED 82 that indicates various types of statuses, and a numeric keypad 83 are provided. By operating the operation portion 80, a user inputs an instruction to perform various types of settings with respect to the image forming apparatus 100 and the paper sheet post-processing device 20 so that various types of functions such as an image forming function and a post-processing function are executed. The liquid crystal display portion 81 shows a status of the system, displays an image forming status and a number of printed sheets, and is used as a touch panel on which functions of double-sided printing, black/white inversion, and so on and various types of settings such as a magnification setting and a printing density setting can be performed. The numeric keypad 83 is used, for example, to set a number of sheets to be printed and to input a fax number of a transmission destination in a case where the image forming apparatus 100 has a fax function.

In addition thereto, in the operation portion 80, there are provided a start button for a user to instruct a start of image formation, a stop/clear button that is used, for example, to cancel image formation, a reset button that is used to reset various types of settings with respect to the system to a default state, and so on.

Next, a description is given of an operation of the paper sheet post-processing device 20. When the paper sheet P (shown by a broken line in FIG. 2 and FIG. 3) that has been subjected to an image forming process at the image forming apparatus 100 is carried in, in a case where an instruction has been given to perform punch hole formation, punch holes are formed at predetermined positions on the paper sheet P conveyed (for example, two positions along its side end edge on the forward side of the apparatus) by the punch hole forming device 21, while in a case where no instruction is given to perform punch hole formation, the paper sheet P passes, as it is, through the punch hole forming device 21.

Then, the paper sheet P is conveyed further to a downstream side by the first ejection roller pair 27. At this time, as shown in FIG. 2, the roller holder 31 has swung upward, so that the ejection roller 29*a* is disposed at a position (retracted position) away from the ejection roller 29*b*, and the stiffening members 32 are retracted in a direction away from the paper sheet P. Thus, the paper sheet P conveyed by the first ejection roller pair 27 passes through a gap between the ejection roller 29*a* and the ejection roller 29*b* to protrude to the ejection tray 50.

In a case where an instruction has been given to perform post-processing on the processing tray 30, at timing at which the rear end of the paper sheet P has passed through the first ejection roller pair 27, the aligning member 33 is driven to orient the paper sheet P in line with the processing tray 30. In this state, the paddle 34 is made to rotate forward (in a counterclockwise direction in FIG. 3), and thus the paper sheet P is drawn in along the processing tray 30, and the rear ends of the paper sheets P thus drawn in are aligned by the butting portion 30*a*. The butting portion 30*a* is not formed continuously over an entire region in the paper sheet width direction but formed to be partially cut out. At this time, the tip end of the paper sheet P is ejected on the ejection tray 50.

Then, when acceptance of a bundle (a predetermined number) of the paper sheets P is completed, in a case where an instruction has been given to perform a binding process, the stapler 40 is made to move to cut-out positions on the butting portion 30*a* where the binding process is performed with respect to rear ends of a bundle of paper sheets.

Further, in a case where a shift-ejection process has been set to be performed, the side end alignment cursors 60 are disposed at a position (reference position) at which the paper sheet P has been accepted or a position (shifted position) that is shifted from the reference position by a predetermined amount in a direction (paper sheet width direction) orthogonal to an ejection direction. Then, the roller holder 31 is made to swing downward to move to a position (contact position) at which the ejection roller 29*a* comes in contact with the ejection roller 29*b*. After that, the ejection roller 29*a* is made to rotate forward (a clockwise direction in FIG. 3), and thus a bundle of paper sheets is conveyed upward along the processing tray 30 to be ejected on the ejection tray 50. Thus, bundles of paper sheets are ejected alternately to the reference ejection position on the ejection tray 50 and to the shifted ejection position that is shifted from the reference position by a predetermined amount in the direction (paper sheet width direction) orthogonal to the ejection direction, so that when ejected on the ejection tray 50, the bundles of paper sheets are sorted by being loaded so as to be staggered in the paper sheet width direction.

On the other hand, in a case where no instruction has been given to perform post-processing on the processing tray 30, timing for making the roller holder 31 to swing downward varies depending on whether or not punch holes have been formed through the paper sheet P.

In a case where no punch holes have been formed through the paper sheet P, before the tip end of the paper sheet P reaches the ejection tray 50, the roller holder 31 is made to swing downward to be disposed at the position (contact position) at which the ejection roller 29*a* comes in contact with the ejection roller 29*b* to nip the paper sheet P. At this time, the stiffening members 32 come in contact with the paper sheet P to impart stiffness to the paper sheet P. Then, in a stiffened state, the tip end of the paper sheet P is ejected on the ejection tray 50 by the second ejection roller pair 29. A configuration also may be adopted in which, in the case where no punch holes have been formed through the paper sheet P, before the tip end of the paper sheet P reaches the second ejection roller pair 29, the second ejection roller pair 29 is brought to a nipping state.

In a case where punch holes have been formed through the paper sheet P, in a non-stiffened state, the tip end of the paper sheet P is ejected on the ejection tray 50 by the first ejection roller pair 27. Then, after the tip end of the paper sheet P has reached the ejection tray 50, when the rear end of the paper sheet P has passed through the detection sensor 35, the roller holder 31 is made to swing downward to be disposed at the position (contact position) at which the ejection roller 29*a* comes in contact with the ejection roller 29*b* to nip the paper sheet P. At this time, the stiffening members 32 come in contact with the paper sheet P to impart stiffness to the paper sheet P.

After that, whether or not punch holes have been formed through the paper sheet P, at timing at which the rear end of the paper sheet P has passed through the first ejection roller pair 27, the aligning member 33 is driven to orient the paper sheet P in line with the processing tray 30. Then, the ejection roller 29*a* is made to rotate forward (the clockwise direction in FIG. 3) to eject the paper sheet P as a whole on the ejection tray 50. In a case where the paper sheet P through which punch holes have been formed is to be ejected on the ejection tray 50 without being subjected to post-processing on the processing tray 30, before the tip end of the paper sheet P passes through the second ejection roller pair 29 (for example, when the tip end of the paper sheet P has passed through the detection sensor 35), a height at which the ejection tray 50 is positioned is raised so that an uppermost surface of the paper sheets P placed on the ejection tray 50 (or the paper sheet placement surface of the ejection tray 50) is at an increased height.

Finally, regardless of whether or not post-processing on the processing tray 30 has been performed, when the paper sheet P as a whole is ejected on the ejection tray 50, after the rear end of the paper sheet P has passed through the second ejection roller pair 29, the roller holder 31 is made to swing upward to release a nip between the second ejection roller pair 29.

In this embodiment, as described above, in a case where the paper sheet P through which punch holes have been formed is to be ejected on the ejection tray 50 without being subjected to post-processing by the stapler 40 and so on, in a state where the stiffening members 32 are retracted in a direction away from the paper sheet P, by the first ejection roller pair 27, the paper sheet P is conveyed until at least the tip end thereof reaches on the ejection tray 50. Thus, in a state where no stiffness has been imparted to the paper sheet P, the tip end of the paper sheet P is ejected on the ejection tray 50, so that a tip end corner part of a subsequent paper sheet P is prevented from being caught in punch holes of the paper sheet P that has already been ejected, and thus the paper sheet P ejected on the ejection tray 50 can be prevented from being pushed out or becoming misaligned.

Furthermore, before the rear end of the paper sheet P passes through the first ejection roller pair 27 (when the rear end of the paper sheet P has been detected by the paper sheet detection sensor 35), the paper sheet P is nipped between the second ejection roller pair 29, with stiffness imparted thereto by the stiffening members 32, and then is ejected on the ejection tray 50 by the second ejection roller pair 29. Thus, in a state of being nipped between the first ejection roller pair 27, the paper sheet P can be nipped between the second ejection roller pair 29, and thus the paper sheet P can be conveyed stably. Since the tip end of the paper sheet P ejected on the ejection tray 50 is oriented in line with (disposed in the same manner as) the paper sheet P that has already been ejected, once at least the tip end of the paper sheet P has been ejected on the ejection tray 50, even when, in a state where stiffness has been imparted to the rear end side of the paper sheet P, the paper sheet P is ejected by the second ejection roller pair 29, in no case does the paper sheet P ejected on the ejection tray 50 get pushed out or become misaligned.

Furthermore, as described above, in a case where the paper sheet P through which punch holes have been formed is to be ejected on the ejection tray 50 without being subjected to post-processing by the stapler 40 and so on, in a state where no stiffness has been imparted to a tip end part of the paper sheet P, the paper sheet P is ejected on the ejection tray 50, so that the tip end part of the paper sheet P is likely to curl up on the ejection tray 50. For this reason, in the case where the paper sheet P through which punch holes have been formed is to be ejected on the ejection tray 50 without being subjected to post-processing by the stapler 40 and so on, the ejection tray 50 is disposed so that a height of a loading position of the paper sheet P as ejected on the ejection tray 50 is raised compared with a case where the paper sheet P through which no punch holes have been formed is to be ejected on the ejection tray 50 without being subjected to post-processing by the stapler 40 and so on. This can prevent the tip end part of the paper sheet P from curling up on the ejection tray 50.

Furthermore, as described above, after the rear end of the paper sheet P has passed through the second ejection roller pair 29, a nip between the second ejection roller pair 29 is released. Thus, it is possible to make preparations beforehand for a subsequent paper sheet post-processing operation and a subsequent paper sheet ejection operation.

Furthermore, as described above, the paper sheet P is deformed by the stiffening members 32 in such a manner that its side end edges (side end edges along punch holes) are bent downward. Thus, in a case where the paper sheet P through which punch holes have been formed is to be ejected on the ejection tray 50 without being subjected to post-processing by the stapler 40 and so on, while the tip end part of the paper sheet P is not deformed in the paper sheet thickness direction, a rear part of the paper sheet P is deformed in such a manner that punch holes are displaced downward. For this reason, a tip end corner part of a subsequent paper sheet P can be effectively prevented from being caught in punch holes of the paper sheet P that has already been ejected.

Second Embodiment

In a second embodiment, whether or not punch holes had been formed through the paper sheet P that has previously been ejected on the ejection tray 50 is stored in the RAM 73 (or the temporary storage portion 74), or there is provided a detection sensor (not shown) that is formed of a PI sensor or the like and detects presence/absence of the paper sheet P on the ejection tray 50.

Further, in the second embodiment, in a case where no instruction has been given to perform post-processing on the processing tray 30, when punch holes had been formed through a paper sheet P that has been ejected on the ejection tray 50 immediately before the paper sheet P being conveyed by the first ejection roller pair 27, or when the paper sheet P is present on the ejection tray 50, in a state where the ejection roller 29*a* (one roller) of the second ejection roller pair 29 is retracted in a direction away from the ejection roller 29*b* (the other roller) thereof, the first ejection roller pair 27 conveys the paper sheet P until at least the tip end thereof reaches on the ejection tray 50. After that, before the rear end of the paper sheet P passes through the first ejection roller pair 27, the second ejection roller pair 29 nips the paper sheet P, and then the second ejection roller pair 29 ejects the paper sheet P on the ejection tray 50.

Furthermore, in a case where whether or not punch holes had been formed through the paper sheet P that has previously been ejected on the ejection tray 50 is stored in the RAM 73 (or the temporary storage portion 74), and there is not provided the detection sensor (not shown) that detects presence/absence of the paper sheet P on the ejection tray 50, when the paper sheet P as a first paper sheet to be processed after turning-on of power to the image forming apparatus 100 and the paper sheet post-processing device 20 is to be ejected on the ejection tray 50 without being subjected to post-processing on the processing tray 30, in a state where the ejection roller 29*a* is retracted in a direction away from the ejection roller 29*b*, the first ejection roller pair 27 conveys the paper sheet P until at least the tip end thereof reaches on the ejection tray 50.

Furthermore, in a case where there is provided the detection sensor (not shown) that detects presence/absence of the paper sheet P on the ejection tray 50, and the paper sheet P as a first paper sheet to be processed after turning-on of power to the image forming apparatus 100 and the paper sheet post-processing device 20 is to be ejected on the ejection tray 50 without being subjected to post-processing on the processing tray 30, when no paper sheet P is present on the ejection tray 50, before the tip end of the paper sheet P reaches on the ejection tray 50, the second ejection roller pair 29 nips the paper sheet P, and then the second ejection roller pair 29 ejects the paper sheet P on the ejection tray 50.

Other structures and operations of the second embodiment are similar to those of the above-described first embodiment.

In this embodiment, as described above, in a case where the paper sheet P is to be ejected on the ejection tray 50 without being subjected to post-processing by the stapler 40 and so on, when punch holes had been formed though a paper sheet P that has been ejected immediately before the paper sheet P being conveyed by the first ejection roller pair 27, or when the paper sheet P is present on the ejection tray 50, in a state where the ejection roller 29*a* is retracted in a direction away from the ejection roller 29*b*, by the first ejection roller pair 27, the paper sheet P is conveyed until at least the tip end thereof reaches on the ejection tray 50. Thus, a tip end corner part of a subsequent paper sheet P is prevented from being caught in punch holes of the paper sheet P that has already been ejected, and thus the paper sheet P ejected on the ejection tray 50 can be prevented from being pushed out or becoming misaligned.

Furthermore, before the rear end of the paper sheet P passes through the first ejection roller pair 27, the paper sheet P is nipped between the second ejection roller pair 29, and then is ejected on the ejection tray 50. Thus, in a state of being nipped between the first ejection roller pair 27, the paper sheet P can be nipped between the second ejection roller pair 29, and thus the paper sheet P can be conveyed stably.

Furthermore, as described above, in a case where the paper sheet P as a first paper sheet to be processed after turning-on of power is to be ejected on the ejection tray 50 without being subjected to post-processing by the stapler 40 and so on, in a state where the ejection roller 29*a* is retracted in a direction away from the ejection roller 29*b*, the first ejection roller pair 27 conveys the paper sheet P until at least the tip end thereof reaches on the ejection tray 50. Thus, even in a case where, due to power-off, information as to whether or not punch holes had been formed through the paper sheet P that has been ejected on the ejection tray 50 is erased from the RAM 73 (or the temporary storage portion 74), a tip end corner part of the paper sheet P as a first paper sheet to be processed after turning-on of power can be easily prevented from being caught in punch holes of the paper sheet P that has been ejected immediately before the power-off.

Furthermore, as described above, the following configuration may be adopted. That is, in a case where the paper sheet P as a first paper sheet to be processed after turning-on of power is to be ejected on the ejection tray 50 without being subjected to post-processing by the stapler 40 and so on, when no paper sheet P is present on the ejection tray 50, before the tip end of the paper sheet P reaches on the ejection tray 50, the second ejection roller pair 29 nips the paper sheet P, and then the second ejection roller pair 29 ejects the paper sheet P on the ejection tray 50.

Other effects of the second embodiment are similar to those of the above-described first embodiment.

Third Embodiment

In a third embodiment, in a case where the paper sheet P as a first paper sheet to be processed after turning-on of power to the image forming apparatus 100 and the paper sheet post-processing device 20 is to be ejected on the ejection tray 50 without being subjected to post-processing on the processing tray 30, in a state where the ejection roller 29*a* is retracted in a direction away from the ejection roller 29*b*, the first ejection roller pair 27 conveys the paper sheet P until at least the tip end thereof reaches on the ejection tray 50. After that, before the rear end of the paper sheet P passes through the first ejection roller pair 27, the second ejection roller pair 29 nips the paper sheet P, and then the second ejection roller pair 29 ejects the paper sheet P on the ejection tray 50.

Other structures and operations of the third embodiment are similar to those of the above-described first embodiment.

In this embodiment, as described above, in a case where the paper sheet P as a first paper sheet to be processed after turning-on of power is to be ejected on the ejection tray 50 without being subjected to post-processing by the stapler 40 and so on, in a state where the ejection roller 29*a* is retracted in a direction away from the ejection roller 29*b*, the first ejection roller pair 27 conveys the paper sheet P until at least the tip end thereof reaches on the ejection tray 50. Thus, unlike the above-described second embodiment, even in a case where whether or not punch holes had been formed through the paper sheet P that has previously been ejected on the ejection tray 50 is not stored in the RAM 73 (or the temporary storage portion 74), and there is not provided the detection sensor (not shown) that detects presence/absence of the paper sheet P on the ejection tray 50, a tip end corner part of the paper sheet P as a first paper sheet to be processed after turning-on of power is prevented from being caught in punch holes of the paper sheet P that has been ejected immediately before power-off, and thus the paper sheet P ejected on the ejection tray 50 can be prevented from being pushed out or becoming misaligned.

Furthermore, before the rear end of the paper sheet P passes through the first ejection roller pair 27, the paper sheet P is nipped between the second ejection roller pair 29, and then is ejected on the ejection tray 50. Thus, in a state of being nipped between the first ejection roller pair 27, the paper sheet P can be nipped between the second ejection roller pair 29, and thus the paper sheet P can be conveyed stably.

Other effects of the third embodiment are similar to those of the above-described first embodiment.

The embodiments disclosed herein are to be construed in all respects as illustrative and not limiting. The scope of the present disclosure is indicated by the appended claims rather than by the foregoing descriptions of the embodiments, and all changes that come within the meaning and range of equivalency of the claims are intended to be embraced therein.

For example, while the above-described embodiments have been described by using, as an example, a configuration in which the image forming apparatus 100 and the paper sheet post-processing device 20 are connected directly to each other, the present disclosure is applicable also to a configuration in which an insertion device that inserts interleaving paper is installed between the image forming apparatus 100 and the paper sheet post-processing device 20.

Furthermore, configurations obtained by combining, as appropriate, the aforementioned embodiments and modification examples also are included in the technical scope of the present disclosure.

What is claimed is:

1. A sheet post-processing device, comprising:

a punch hole forming device that forms punch holes along a side end edge of a sheet parallel to a sheet conveyance direction;

a processing tray that is disposed on a downstream side of the punch hole forming device in the sheet conveyance direction, and accepts and loads thereon a predetermined number of sheets;

an ejection tray that is disposed on a downstream side of the processing tray in the sheet conveyance direction, and a sheet is ejected thereon;

an ejection roller pair that ejects, on the ejection tray, a sheet on the processing tray, the ejection roller pair including an upper ejection roller and a lower election roller;

a conveyance roller pair that is disposed above an upstream side of the processing tray in the sheet conveyance direction and conveys a sheet;

a roller holder that supports the upper ejection roller and that is swingable up and down;

a stiffening member that is provided on the roller holder and that comes in contact with a sheet nipped between the ejection roller pair and deforms the sheet in a sheet thickness direction to impart stiffness to the sheet;

an on-tray processing portion that performs post-processing with respect to a sheet on the processing tray;

a sheet detection sensor that is provided on an upstream side of the conveyance roller pair in the sheet conveyance direction and that detects presence or absence of the sheet; and a control portion, wherein in a case where a sheet through which punch holes have been formed by the punch hole forming device is to be ejected on the ejection tray without being subjected to post-processing by the on-tray processing portion, when a rear end of the sheet is detected by the sheet detection sensor, the control portion makes the roller holder swing up and, in a state where the stiffening member is retracted in a direction away from the sheet, makes the conveyance roller pair rotate to convey the sheet until at least a tip end thereof reaches on the ejection tray, and then, when the rear end of the sheet is detected by the sheet detection sensor, the control portion makes the roller holder swing down and closes the ejection roller pair to nip the sheet, with the stiffening member imparting stiffness to the sheet, and then the control portion makes the ejection roller pair rotate to eject the sheet on the ejection tray.

2. The sheet post-processing device according to claim 1, wherein the ejection tray is vertically movable to a position appropriate to eject the sheet, and in a case where a sheet through which punch holes have been formed by the punch hole forming device is to be ejected on the ejection tray without being subjected to post-processing by the on-tray processing portion, the control portion disposes the ejection tray so that a height of a loading position of the sheet as ejected on the ejection tray is raised compared with a case where a sheet through which no punch holes have been formed is to be ejected on the ejection tray without being subjected to post-processing by the on-tray processing portion.

3. The sheet post-processing device according to claim 1, wherein when the rear end of the sheet is detected by the sheet detection sensor, the control portion makes the roller holder swing up to release, a nip between the ejection roller pair.

4. The sheet post-processing device according to claim 1, wherein in a case where a sheet through which punch holes have been formed by the punch hole forming device is to be ejected on the ejection tray without being subjected to post-processing by the on-tray processing portion, the control portion makes the roller holder swing up to release a nip between the ejection roller pair and, in a state where the stiffening member is retracted in the direction away from the sheet, makes the conveyance roller pair rotate to convey the sheet until at least the tip end thereof reaches on the ejection tray.

5. An image forming system, comprising:

the sheet post-processing device according to claim 1; and an image forming apparatus that is joined to the sheet post-processing device, forms an image on a sheet, and conveys the sheet on which the image has been formed to the sheet post-processing device.

6. A sheet post-processing device, comprising:

a punch hole forming device that forms punch holes along a side end edge of a sheet parallel to a sheet conveyance direction;

a processing tray that is disposed on a downstream side of the punch hole forming device in the sheet conveyance direction, and accepts and loads thereon a predetermined number of sheets;

an ejection tray that is disposed on a downstream side of the processing tray in the sheet conveyance direction, and a sheet is ejected thereon;

an ejection roller pair that ejects, on the ejection tray, a sheet on the processing tray, the election roller pair including an upper ejection roller and a lower ejection roller;

a conveyance roller pair that is disposed above an upstream side of the processing tray in the sheet conveyance direction and conveys a sheet;

a roller holder that supports the upper election roller and that is swingable up and down;

an on-tray processing portion that performs post-processing with respect to a sheet on the processing tray, a sheet detection sensor that is provided on an upstream side of the conveyance roller pair in the sheet conveyance direction and that detects presence or absence of the sheet; and a control portion wherein in a case where a sheet is to be ejected on the ejection tray without being subjected to post-processing by the on-tray processing portion, when punch holes had been formed through a sheet that has been ejected immediately before a sheet being conveyed by the conveyance roller pair, or when a sheet is present on the ejection tray, the control portion makes the roller holder swing up and, in a state where the upper ejection roller is retracted in a direction away from the lower ejection roller, makes the conveyance roller pair rotate to convey the sheet until at least a tip end thereof reaches on the ejection tray, and then, when a rear end of the sheet is detected by the sheet detection sensor, the control portion makes the roller holder swing down to close the ejection roller pair to nip the sheet, and then the control portion makes the ejection roller pair rotate to eject the sheet on the ejection tray.

7. The sheet post-processing device according to claim 6, wherein in a case where a first sheet to be processed after turning-on of power is to be ejected on the ejection tray without being subjected to post-processing by the on-tray processing portion, the control portion makes the roller holder swing up and, in the state where the upper ejection roller is retracted in the direction away from the lower election roller, makes the conveyance roller pair to convey the first sheet until at least the tip end thereof reaches on the ejection tray.

8. The sheet post-processing device according to claim 6, wherein in a case where a first sheet to be processed after turning-on of power is to be ejected on the ejection tray without being subjected to post-processing by the on-tray processing portion, when no sheet is present on the ejection tray, before the tip end of the first sheet reaches on the ejection tray, the control portion makes the roller holder swing down to close the ejection roller pair to nip the first sheet, and then makes the ejection roller pair rotate to eject the first sheet on the ejection tray.

9. An image forming system, comprising:

the sheet post-processing device according to claim 6; and an image forming apparatus that is joined to the sheet post-processing device, forms an image on a sheet, and conveys the sheet on which the image has been formed to the sheet post-processing device.

10. A sheet post-processing device, comprising:

a punch hole forming device that forms punch holes along a side end edge of a sheet parallel to a sheet conveyance direction;

a processing tray that is disposed on a downstream side of the punch hole forming device in the sheet conveyance direction, and accepts and loads thereon a predetermined number of sheets;

an ejection tray that is disposed on a downstream side of the processing tray in the sheet conveyance direction, and a sheet is ejected thereon;

an ejection roller pair that ejects, on the ejection tray, a sheet on the processing tray, the ejection roller pair including an upper ejection roller and a lower ejection roller;

a conveyance roller pair that is disposed above an upstream side of the processing tray in the sheet conveyance direction and conveys a sheet;

a roller holder that supports the upper ejection roller and that is swingable up and down;

an on-tray processing portion that performs post-processing with respect to a sheet on the processing tray, a sheet detection sensor that is provided on an upstream side of the conveyance roller pair in the sheet conveyance direction and that detects presence or absence of the sheet; and a control portion wherein in a case where a first sheet to be processed after turning-on of power is to be ejected on the ejection tray without being subjected to post-processing by the on-tray processing portion, the control portion makes the roller holder swing up and, in a state where the upper election roller is retracted in a direction away from the lower election roller, makes the conveyance roller pair rotate to convey the first sheet until at least a tip end thereof reaches on the ejection tray, and then, when a rear end of the first sheet is detected by the sheet detection sensor, the control portion makes the roller holder swing down and closes the ejection roller pair to nip the first sheet, and then the control portion makes the ejection roller pair rotate to eject the first sheet on the ejection tray.

11. An image forming system, comprising:

the sheet post-processing device according to claim 10; and an image forming apparatus that is joined to the sheet post-processing device, forms an image on a sheet, and conveys the sheet on which the image has been formed to the sheet post-processing device.

* * * * *